US010182645B2

(12) United States Patent
Xue et al.

(10) Patent No.: US 10,182,645 B2
(45) Date of Patent: Jan. 22, 2019

(54) ON-LINE WHEEL CLEANING DEVICE

(71) Applicant: CITIC Dicastal CO., LTD, Qinhuangdao (CN)

(72) Inventors: Bowen Xue, Qinhuangdao (CN); Guangcai Chen, Qinhuangdao (CN); Jiandong Guo, Qinhuangdao (CN); Weidong Liu, Qinhuangdao (CN); Yao Zheng, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 246 days.

(21) Appl. No.: 15/172,444

(22) Filed: Jun. 3, 2016

(65) Prior Publication Data

US 2016/0353873 A1 Dec. 8, 2016

(30) Foreign Application Priority Data

Jun. 3, 2015 (CN) ..... 2015 1 0298272

(51) Int. Cl.
*A46B 13/00* (2006.01)
*A46B 13/02* (2006.01)

(52) U.S. Cl.
CPC ..... *A46B 13/02* (2013.01)

(58) Field of Classification Search
USPC ..... 15/21.1, 88.3, 104.09, 104.19
See application file for complete search history.

(56) References Cited

U.S. PATENT DOCUMENTS 3,849,819 A * 11/1974 Sullivan ..... B29D 30/0005 118/72
4,473,921 A * 10/1984 Weber ..... B08B 9/035 15/104.09
7,597,759 B1 * 10/2009 Delmoro ..... B60C 25/132 118/214

* cited by examiner

*Primary Examiner* — Joseph J Hail
*Assistant Examiner* — Shantese McDonald
(74) *Attorney, Agent, or Firm* — Maier & Maier, PLLC

(57) ABSTRACT

The present invention discloses an on-line wheel cleaning device, having a frame, a cylinder, a motor, a brush chassis, radial brushes, a spline shaft and a spline housing, wherein a sensor enables a wheel to be primarily positioned; a clamping cylinder enables two left clamping rollers and right clamping rollers to clamp the wheel by way of gears, left racks, right racks and a guide rail; a jacking cylinder is used for jacking the brush chassis and the radial brushes through the spline shaft and enabling the brush chassis and the radial brushes to touch a flange plate and a center hole of the wheel, respectively; the motor drives a first belt pulley, the spline housing and the spline shaft to rotate through a synchronous belt and a first belt pulley; an adjusting cylinder jacks up an apex to drive the four radial brushes to move outwards respectively.

4 Claims, 5 Drawing Sheets

ON-LINE WHEEL CLEANING DEVICE

TECHNICAL FIELD

The present invention relates to a cleaning device, and specifically to an online bottom powder cleaning device.

BACKGROUND ART

In a production process of an aluminum alloy wheel, spraying is a very important procedure, and the procedure is carried out to achieve a better appearance effect for the wheel. However, the procedure contains numerous steps, after spraying bottom powder and colored paint on the wheel for the first time, and before carrying out the next step, bottom powder on a ring flange of the wheel and at a center hole must be removed; at this time, if the bottom powder is removed manually, the efficiency is absolutely very low, and the effect is not good; and therefore, an automatic device is needed to quickly remove the bottom powder online.

SUMMARY OF THE INVENTION

The purpose of the present invention is to provide an on-line wheel cleaning device, which can meet the demand of online cleaning bottom powder on a flange face and a center hole of a wheel in a wheel spraying process.

To fulfill the aforementioned purpose, the technical solution of the present invention is as follows: the on-line wheel cleaning device is composed of a frame, a jacking cylinder, a bottom plate, a transition end cover, a rotation ring, a spline shaft, a first belt wheel, a spline housing, a bearing seat, a middle plate, a piston, a cylinder rod, an end cover, an apex, a brush chassis, slide blocks, radial brushes, left clamping rollers, left gear racks, a left sliding plate, a guide rail, a cushion block, gears, a right sliding plate, right gear racks, right clamping rollers, a synchronous belt, a second belt wheel, a motor, a clamping cylinder, a spring, a pull ring and the like, wherein the jacking cylinder fixedly provided with the transition end cover at the output end is fixed below the bottom plate; and the lower end of the spline shaft is fixed in the rotation ring through a bearing, and the transition end cover is connected with the rotation ring through a screw.

The piston fixedly provided with the cylinder rod is matched with the inner wall of the top end of the spline shaft, and the piston and the end cover jointly form an adjusting cylinder.

The spline shaft is matched with the spline housing, and the first belt wheel is fixed below the spline housing; the spline housing is fixed in the bearing seat through a bearing; the bearing seat is mounted below the middle plate; the apex is fixed at the top end of the cylinder rod, and the conical part of the apex is matched with four slide blocks; the brush chassis is fixed at the top end of the spline shaft; four radial brushes are respectively fixed on the four slide blocks; the inner sides of the four radial brushes are respectively connected with one spring, and the other end of each spring is connected with the pull ring at the same time; and the motor fixedly provided with the second belt wheel at the output end is fixed on the side face of the frame, and the synchronous belt is simultaneously connected with the belt wheel I and the second belt wheel.

Two left clamping rollers and two left gear racks are all fixed below the left sliding plate; the left sliding plate is fixed below the top of the frame through the guide rail and the cushion block; two right gear racks and the right clamping rollers are all fixed below the right sliding plate; the right sliding plate is also fixed below the top of the frame through the guide rail and the cushion block; two gears fixed below the top of the frame are simultaneously meshed with the left gear racks and the right gear racks; and the clamping cylinder is also fixed below the top of the frame, and the output end of the clamping cylinder is connected with the right sliding plate.

The lower ends of the left clamping rollers and the right clamping rollers are thin and the upper ends thereof are slightly thicker to form inverted cones, so as to effectively press the wheel when clamping the same.

Each radial brush is composed of four quadrant radial brushes including a first radial brush, a second radial brush, a third radial brush and a fourth radial brush.

The slide blocks are T-shaped and are matched with four T-shaped slide ways in the brush chassis. In actual use, a sensor enables the wheel to be primarily positioned, the clamping cylinder enables the two left clamping rollers and the two right clamping rollers to clamp the wheel through the gears, the left gear racks, the right gear racks and the guide rail, the jacking cylinder jacks up the brush chassis and the radial brushes through the spline shaft to enable the brush chassis and the radial brushes touch the ring flange and the center hole of the wheel respectively, and the motor drives the first belt wheel, the spline housing and the spline shaft to rotate through the synchronous belt and the second belt wheel, so as to enable the brush chassis and the radial brushes to simultaneously rotate; and the adjusting cylinder jacks up the apex to drive the four radial brushes to move outwards respectively, so that the radial size diameters thereof are increased to guarantee full touch with wheels with center holes of any sizes.

When in use, the on-line wheel cleaning device provided by the present invention can meet the demand of online cleaning bottom powder on a flange face and the center hole in a wheel spraying process, and not only has high efficiency, but also has an ideal cleaning effect, moreover, the on-line wheel cleaning device can reduce the labor intensity of workers, and meanwhile has the advantages of high degree of automation, advanced process, strong universality, safe and stable performance, etc.

Figure 1:
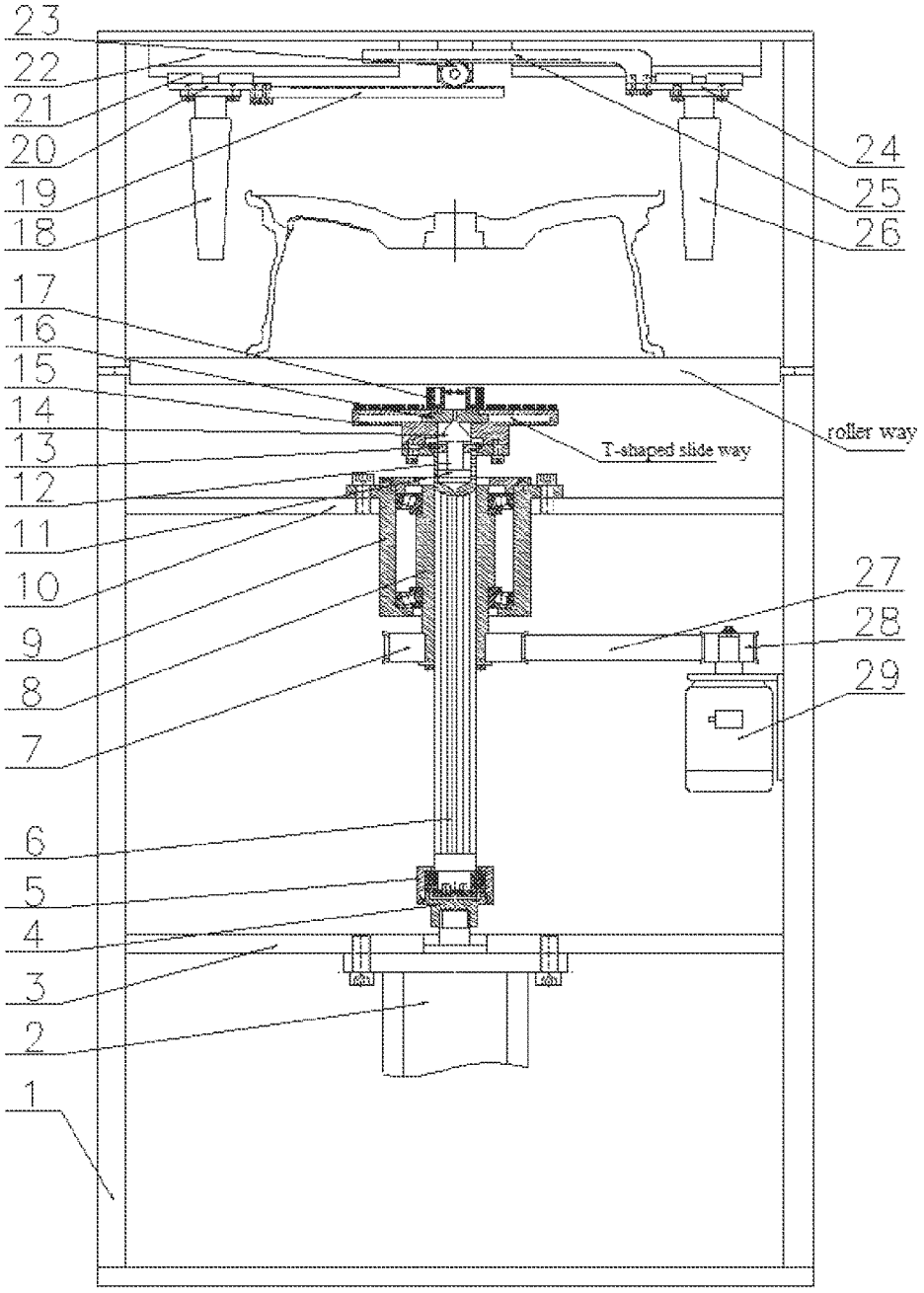
FIG. 1 is a front view of an on-line wheel cleaning device in the present invention.
Figure 2:
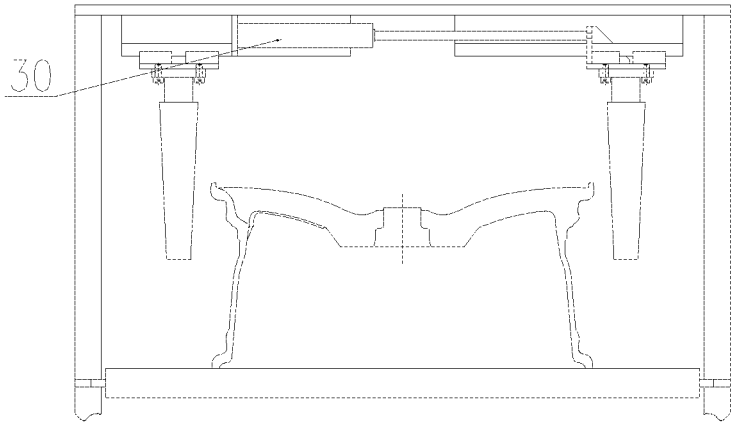
FIG. 2 is a partial view of a clamping portion of an on-line wheel cleaning device in the present invention.
Figure 3:
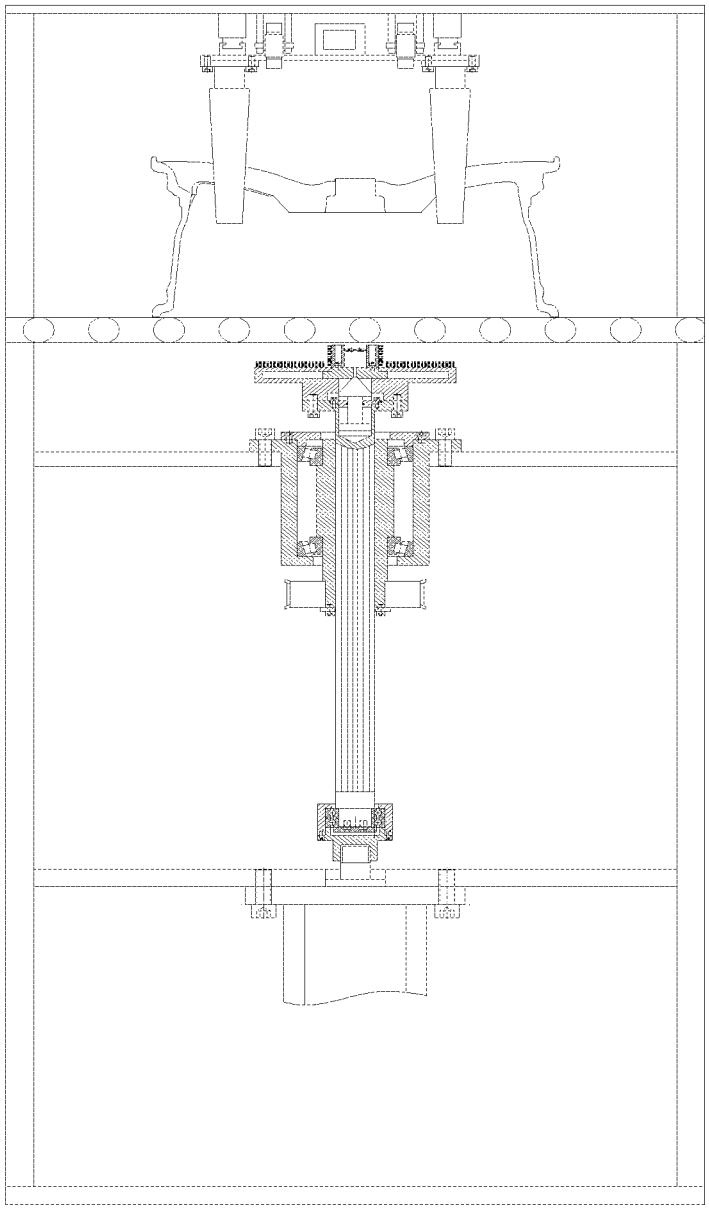
FIG. 3 is a left view of an on-line wheel cleaning device in the present invention.
Figure 4:
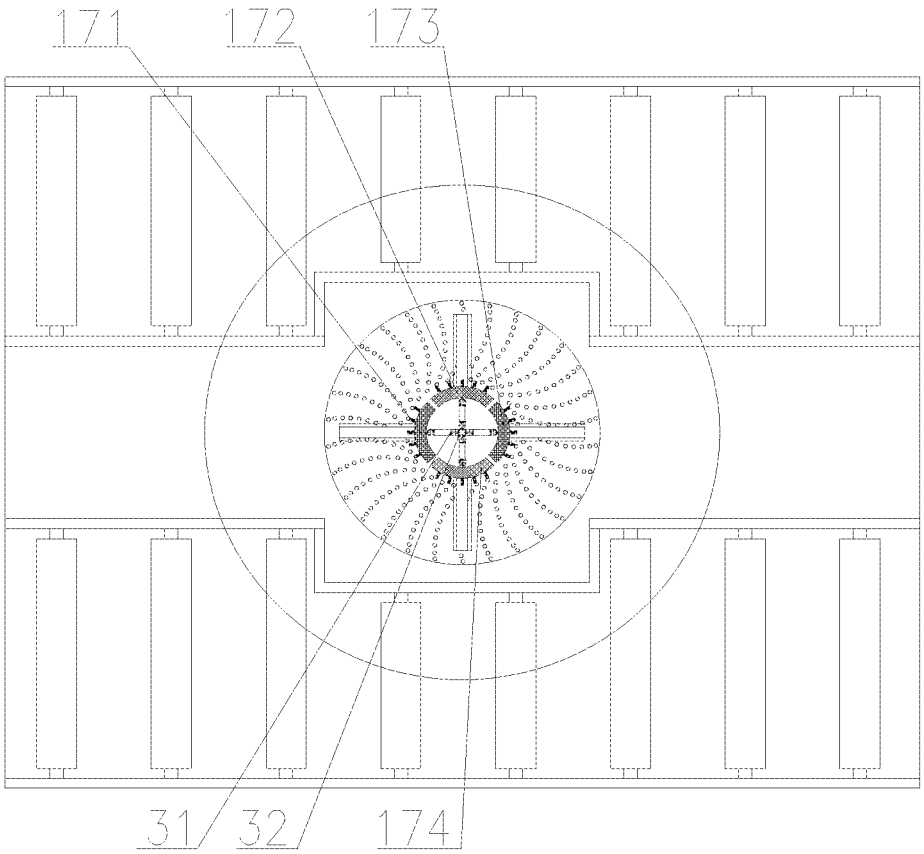
FIG. 4 is a partial top view of an on-line wheel cleaning device in the present invention.
Figure 5:
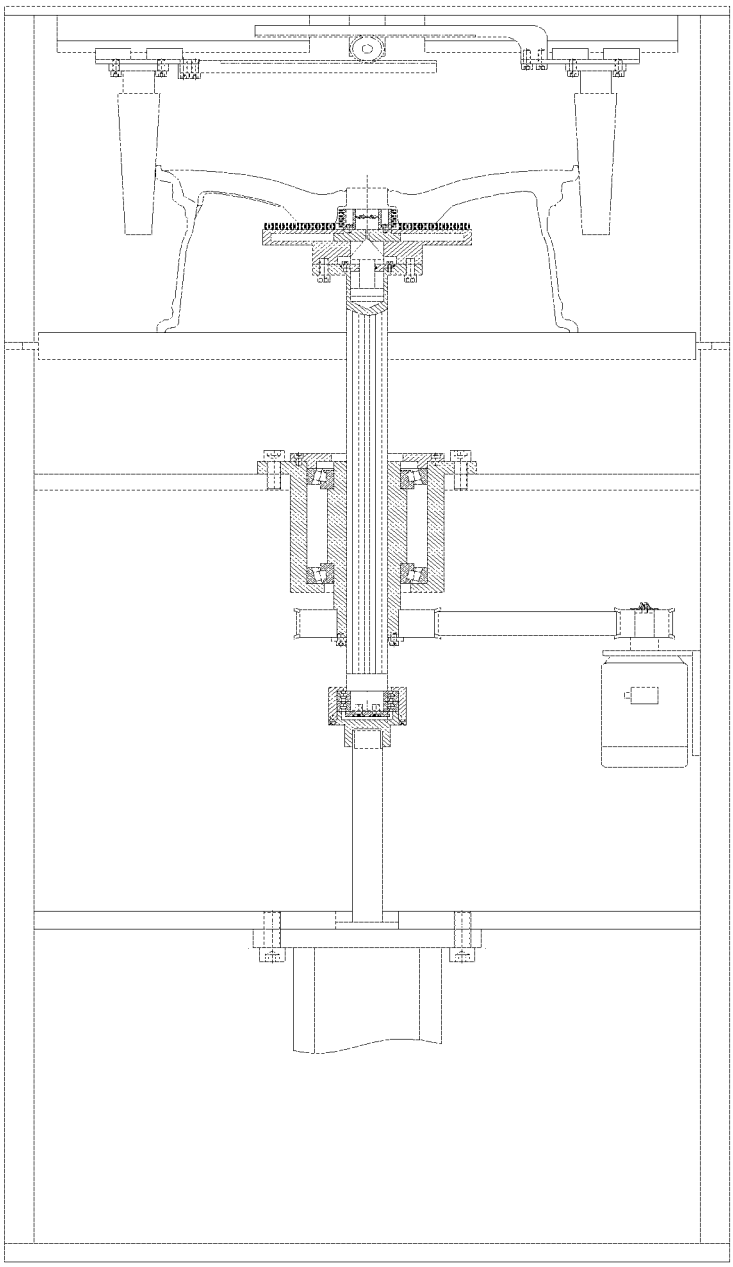
FIG. 5 is a front view when an on-line wheel cleaning device in the present invention is at work.

In the figures, 1 represents a frame, 2 represents a jacking cylinder. 3 represents a bottom plate, 4 represents a transition end cover, 5 represents a rotation ring, 6 represents a spline shaft, 7 represents a first belt wheel, 8 represents a spline housing, 9 represents a bearing seat, 10 represents a middle plate, 11 represents a piston, 12 represents a cylinder rod, 13 represents an end cover, 14 represents an apex, 15 represents a brush chassis, 16 represents a slide block, 17 represents a radial brush, 18 represents a left clamping roller, 19 represents a left gear rack, 20 represents a left sliding plate, 21 represents a guide rail. 22 represents a cushion block. 23 represents a gear, 24 represents a right sliding plate, 25 represents a right gear rack, 26 represents a right clamping roller, 27 represents a synchronous belt, 28 represents a second belt wheel, 29 represents a motor, 30 represents a clamping cylinder, 31 represents a spring, 32 represents a pull ring, 171 represents a first radial brush, 172 represents a second radial brush. 173 represents a third radial brush and 174 represents a fourth radial brush.

DETAILED DESCRIPTION OF THE INVENTION

Details and working conditions of a specific device proposed according to the present invention will be illustrated below in combination with the accompanying drawings.

The device is composed of a frame 1, a jacking cylinder 2, a bottom plate 3, a transition end cover 4, a rotation ring 5, a spline shaft 6, a first belt wheel 7, a spline housing 8, a bearing seat 9, a middle plate 10, a piston 11, a cylinder rod 12, an end cover 13, an apex 14, a brush chassis 15, slide blocks 16, radial brushes 17, left clamping rollers 18, left gear racks 19, a left sliding plate 20, a guide rail 21, a cushion block 22, gears 23, a right sliding plate 24, right gear racks 25, right clamping rollers 26, a synchronous belt 27, a second belt wheel 28, a motor 29, a clamping cylinder 30, a spring 31, a pull ring 32 and the like, wherein the jacking cylinder 2 fixedly provided with the transition end cover 4 at the output end is fixed below the bottom plate 3; and the lower end of the spline shaft 6 is fixed in the rotation ring 5 through a bearing, and the transition end cover 4 is connected with the rotation ring 5 through a screw.

The piston 11 fixedly provided with the cylinder rod 12 is matched with the inner wall of the top end of the spline shaft 6, and the piston 11 and the end cover 13 jointly form an adjusting cylinder. The spline shaft 6 is matched with the spline housing 8, and the first belt wheel 7 is fixed below the spline housing 8; the spline housing 8 is fixed in the bearing seat 9 through a bearing; the bearing seat 9 is mounted below the middle plate 10; the apex 14 is fixed at the top end of the cylinder rod 12, and the conical part of the apex is matched with four slide blocks 16; the brush chassis 15 is fixed at the top end of the spline shaft 16; four radial brushes 17 are respectively fixed on the four slide blocks 16; the inner sides of the four radial brushes 17 are respectively connected with one spring 31, and the other end of each spring 31 is connected with the pull ring 32 at the same time; and the motor 29 fixedly provided with the second belt wheel 28 at the output end is fixed on the side face of the frame 1, and the synchronous belt 27 is simultaneously connected with the first belt wheel 7 and the second belt wheel 28.

Two left clamping rollers 18 and two left gear racks 19 are all fixed below the left sliding plate 20; the left sliding plate 20 is fixed below the top of the frame 1 through the guide rail 21 and the cushion block 22; two right gear racks 25 and right clamping rollers 26 are all fixed below the right sliding plate 24; the right sliding plate 24 is also fixed below the top of the frame 1 through the guide rail 21 and the cushion block 22; two gears 23 fixed below the top of the frame 1 are simultaneously meshed with the left gear racks 19 and the right gear racks 25; and the clamping cylinder 30 is also fixed below the top of the frame 1, and the output end of the clamping cylinder 30 is connected with the right sliding plate 24.

The lower ends of the left clamping rollers 18 and the right clamping rollers 26 are thin and the upper ends thereof are slightly thicker to form inverted cones, so as to effectively press a wheel when clamping the same.

Each radial brush 17 is composed of four quadrant radial brushes including a first radial brush 171, a second radial brush 172, a third radial brush 173 and a fourth radial brush 174.

The slide blocks 16 are T-shaped and are matched with four T-shaped slide ways in the brush chassis 15.

In a working process, a sensor enables the wheel to be primarily positioned, the clamping cylinder 30 enables the two left clamping rollers 18 and the two right clamping rollers 26 to clamp the wheel through the gears 23, the left gear racks 19, the right gear racks 25 and the guide rail 21, the jacking cylinder 2 jacks up the brush chassis 15 and the radial brushes 17 through the spline shaft 6 to enable the brush chassis 15 and the radial brushes 17 touch the ring flange and the center hole of the wheel respectively, and the motor 29 drives the belt wheel 17, the spline housing 8 and the spline shaft 6 to rotate through the synchronous belt 27 and the second belt wheel 28, so as to enable the brush chassis 5 and the radial brushes 17 to simultaneously rotate; and the adjusting cylinder jacks up the apex 14 to drive the four radial brushes 17 to move outwards respectively, so that the radial size diameters thereof are increased to guarantee full touch with wheels with center holes of any sizes.

The invention claimed is:

1. An on-line wheel cleaning device, comprising: a frame, a jacking cylinder, a bottom plate, a transition end cover, a rotation ring, a spline shaft, a first belt wheel, a spline housing, a bearing seat, a middle plate, a piston, a cylinder rod, an end cover, an apex, a brush chassis, slide blocks, radial brushes, left clamping rollers, left gear racks, a left sliding plate, a guide rail, a cushion block, gears, a right sliding plate, right gear racks, right clamping rollers, a synchronous belt, a second belt wheel, a motor, a clamping cylinder, a spring and a pull ring, wherein the bottom plate is arranged within the frame and located at a lower part of the frame;

wherein the jacking cylinder is fixed below the bottom plate and is fixedly provided with the transition end cover at its output end, the transition end cover being above the bottom plate;

wherein the spline shaft has a lower end that is fixed in the rotation ring through a bearing and the rotation ring is fixed in the transition end cover;

wherein the piston engages an inner wall of a top end of the spline shaft and is fixedly provided with the cylinder rod, and the piston and the end cover jointly form an adjusting cylinder;

wherein the spline shaft engages the spline housing, and the first belt wheel is fixed below the spline housing;

wherein the spline housing is fixed in the bearing seat through a bearing and the bearing seat is mounted below the middle plate;

wherein the apex is fixed at a top end of the cylinder rod, and a conical part of the apex engages four slide blocks;

wherein the brush chassis is fixed at the top end of the spline shaft and four radial brushes are respectively fixed on the four slide blocks;

wherein an inner side of each of the four radial brushes is connected with one end of one spring, and the other ends of the four springs are connected with the pull ring at the same time;

wherein the motor is fixedly provided with the second belt wheel at its output end and is fixed on a side face of the frame, and the synchronous belt is simultaneously connected with the first belt wheel and the second belt wheel;

wherein two left clamping rollers and two left gear racks are all fixed below the left sliding plate and the left sliding plate is fixed below a top of the frame through the guide rail and the cushion block; two right gear racks and right clamping rollers are all fixed below the right sliding plate; the right sliding plate is also fixed below the top of the frame through the guide rail and the cushion block; two gears fixed below the top of the frame are simultaneously meshed with the left gear racks and the right gear racks; and the clamping cylinder is also fixed below the top of the frame, and an output end of the clamping cylinder is connected with the right sliding plate; and wherein the spline shaft is able to drive the adjusting cylinder so that the adjusting cylinder jacks up the apex to drive the four radial brushes to move outwards respectively, in order to change the radial size of the radial brushes.

2. The on-line wheel cleaning device according to claim 1, wherein the left clamping rollers and the right clamping rollers are inverted cones in shape.

3. The on-line wheel cleaning device according to claim 1, wherein the radial brush comprises four quadrant radial brushes including a first radial brush, a second radial brush, a third radial brush and a fourth radial brush.

4. The on-line wheel cleaning device according to claim 1, wherein the slide blocks are T-shaped and engage four T-shaped slide ways in the brush chassis.

* * * * *